US012357137B2

(12) United States Patent
Röwekämper

(10) Patent No.: US 12,357,137 B2
(45) Date of Patent: Jul. 15, 2025

(54) VACUUM CLEANER ASSEMBLY

(71) Applicant: Mytek GmbH, Emsdetten (DE)

(72) Inventor: Felix Röwekämper, Ibbenbüren (DE)

(73) Assignee: MYTEK GMBH, Emsdetten (DE)

( * ) Notice: Subject to any disclaimer, the term of this patent is extended or adjusted under 35 U.S.C. 154(b) by 620 days.

(21) Appl. No.: 17/310,655

(22) PCT Filed: Feb. 21, 2020

(86) PCT No.: PCT/EP2020/054706

§ 371 (c)(1),
(2) Date: Aug. 16, 2021

(87) PCT Pub. No.: WO2020/169844

PCT Pub. Date: Aug. 27, 2020

(65) Prior Publication Data

US 2021/0386257 A1 Dec. 16, 2021

(30) Foreign Application Priority Data

Feb. 22, 2019 (DE) ..... 20 2019 101 044.4
Feb. 5, 2020 (DE) ..... 10 2020 102 903.9

(51) Int. Cl.
*A47L 9/06* (2006.01)
*A47L 5/36* (2006.01)
(Continued)

(52) U.S. Cl.
CPC ..... *A47L 9/066* (2013.01); *A47L 5/362* (2013.01); *A47L 9/0072* (2013.01); *A47L 9/0653* (2013.01); *A47L 9/248* (2013.01)

(58) Field of Classification Search
CPC ..... A47L 5/362; A47L 9/0072; A47L 9/248; A47L 9/242; A47L 9/244; A47L 9/02–24
(Continued)

(56) References Cited

U.S. PATENT DOCUMENTS 3,608,126 A 9/1971 Tacoma et al.
3,739,421 A 6/1973 Fukuba
(Continued)

FOREIGN PATENT DOCUMENTS

AT 413789 B 6/2006
CN 101524259 A 9/2009
(Continued)

OTHER PUBLICATIONS

WIPO Translation JP-2013128617-A; Suction Port Body and Vacuum Cleaner; Yokoyama, Hiroshi; Apr. 7, 2013 (Year: 2013).*
(Continued)

*Primary Examiner* — Brian D Keller
*Assistant Examiner* — Sidney D Full
(74) *Attorney, Agent, or Firm* — Greer, Burns & Crain, Ltd

(57) ABSTRACT

A vacuum cleaner assembly and vacuum cleaner with a vacuum cleaner assembly, including a suction device with a basic body with a first end with at least one suction inlet for connection with a suction tube and/or suction hose of the vacuum cleaner. Furthermore, the basic body divides at a second end into two substantially tubular suction ducts, each having a suction intake, wherein one suction arm each is associated with the suction intakes, and wherein the suction arms are provided pivotable about the associated suction duct.

30 Claims, 12 Drawing Sheets

(51) Int. Cl.
*A47L 9/00* (2006.01)
*A47L 9/24* (2006.01)

(58) Field of Classification Search
USPC ..... 15/416, 417, 418, 422.1, 415.1
See application file for complete search history.

(56) References Cited

U.S. PATENT DOCUMENTS

| | | | | |
|---|---|---|---|---|
| 6,536,076 | B2 | 3/2003 | Scian et al. | |
| 8,402,602 | B2 | 3/2013 | Jonsson et al. | |
| 2004/0237250 | A1* | 12/2004 | Lim | A47L 9/066 15/415.1 |
| 2018/0000299 | A1* | 1/2018 | Caldwell | A47L 9/242 |
| 2020/0405110 | A1* | 12/2020 | Furuta | A47L 9/2852 |
| 2020/0405115 | A1* | 12/2020 | Furuta | A47L 9/2805 |
| 2021/0161341 | A1* | 6/2021 | Imae | A47L 9/0477 |

FOREIGN PATENT DOCUMENTS

| | | | | |
|---|---|---|---|---|
| DE | 4413071 | A1 | | 10/1995 |
| EP | 1222892 | A1 | | 7/2002 |
| EP | 2098150 | A2 | | 9/2009 |
| JP | H0176747 | U | | 5/1989 |
| JP | 2013128617 | A | * | 7/2013 |
| WO | 2005035135 | A1 | | 4/2005 |
| WO | 2008114301 | A1 | | 9/2008 |

OTHER PUBLICATIONS

WIPO Translation JP 2013/128617; Suction Port Body and Vacuum Cleaner; Yokoyama, Hiroshi; Apr. 7, 2013 (Year: 2013).*
International Search Report and Written Opinion received for PCT/EP2020/054706, mailed Jul. 20, 2020.
Search Report received in Chinese Application No. 202080015471.3, dated Jul. 22, 2022.
First Office Action received in received in Chinese Application No. 202080015471.3, dated Jul. 27, 2022.

* cited by examiner

VACUUM CLEANER ASSEMBLY

BACKGROUND

The present invention relates to a vacuum cleaner assembly, in particular a floor nozzle, comprising at least one suction device including at least one basic body that is at least partially hollow, with at least one first end with at least one suction inlet, in particular for connection with at least one suction tube and/or suction hose of a vacuum cleaner. Furthermore the present invention relates to a vacuum cleaner including such a vacuum cleaner assembly.

Floor nozzles for vacuum cleaners are comprehensively known. These floor nozzles are predominantly satisfactory and reliable in operation. Thus, a number of different floor nozzles can be used, according to the application. For example, floor nozzles with glide surfaces are used for wall-to-wall carpeting. For vacuuming hard floors such as tiles, wooden floors or laminates, floor nozzles with brushes are used. Also, floor nozzles are known where a brush can be activated, so that such a floor nozzle can be adjusted flexibly in relation to the vacuumed surface.

The drawback of conventional floor nozzles is that they tend to have a given basic shape and that the floor must be cleared as far as possible for vacuuming so as to be unimpeded by obstacles. Thus, floor nozzles tend to not pass through chair legs, or maneuvering between and around them can be difficult.

Also, as a rule free spaces and gaps between pieces of furniture are of such a size or width so that a conventional floor nozzle can only just not enter the gap.

Floor nozzles with pivoting or telescopic attachment parts have become known which are intended to effect improvements. For example, documents U.S. Pat. Nos. 3,608,126 A, 6,536,076 B2, DE 4 413 071 A1, FR 2 076 110 A1 and AT 413789 B show these known floor nozzles. However, some of these floor nozzles are very complicated in construction, not user friendly, and/or comparatively large overall, so that they cannot enter narrow gaps despite the mobile attachment parts.

It is therefore the object of the present invention to provide an alternative floor nozzle which improves, at least partially, the drawbacks indicated above.

SUMMARY

The vacuum cleaner assembly according to the invention comprises at least one suction device with at least one basic body configured hollow at least in sections, having at least one first end with at least one suction inlet, which serves in particular for connection with at least one suction tube and/or a suction hose of a vacuum cleaner. According to the invention, the basic body divides at a second end into at least two, substantially tubular suction ducts, each having at least one suction intake. At least one suction arm is associated with each of the at least two suction intakes, at least one suction arm being provided pivotable about the associated suction duct.

The vacuum cleaner assembly according to the invention is in particular configured as a floor nozzle for a vacuum cleaner respectively for any type of suction machine. The vacuum cleaner assembly according to the invention may for example be used with a conventional domestic vacuum cleaner. The application is not limited to such a vacuum cleaner but it may also be used for industrial vacuum cleaners, wet-type vacuum cleaners, wet-dry vacuum cleaners, dry vacuum cleaners, and/or other vacuum cleaner-type devices.

Each of the at least one suction arm and in particular both of the suction arms are provided for rotation respectively pivoting around the associated suction duct. It is particularly preferred for the suction arms, when positioned upright on the floor in the operating position, to be in particular pivotable back and/or forth. Pivoting is in particular preferred in a substantially horizontal direction, i.e. across the floor.

According to the application, the fact that the suction arms are provided for pivoting respectively rotation around a suction duct, means in particular that the suction arms can rotate around, or together with, the suction ducts.

In configurations in which for example the suction ducts are associated with the basic body, the suction arms then being preferably fixedly or non-rotatably connected, and/or integrally manufactured, with the basic body, the suction arms are preferably rotatably or pivotally received at the suction ducts. Then the suction duct is stationary, and the suction arms rotate around the suction duct.

In configurations in which the suction ducts are associated e.g. with the suction arms, for example if they are manufactured integrally, and/or non-rotatably connected, with the suction arms, the suction arms are preferably accommodated on the basic body for rotation by means of the suction ducts, so that the suction arms and the suction ducts rotate jointly. Then, a suitable bearing or accommodation of the suction ducts on the basic body is preferably provided.

The basic body or the suction device is in particular compact or configured as narrow as possible. It is in particular preferred for the basic body to be not at all, or insignificantly, wider than the suction inlet, so that the entire width is not significantly wider than is a conventional suction tube of a vacuum cleaner. It is thus possible, due to the pivoting or nearly entirely folding in, up to 90° or even more, to provide an extremely narrow vacuum cleaner assembly. Thus, the vacuum cleaner assembly can be inserted into very narrow gaps, depending on the application.

The basic shape of the basic body is preferably configured substantially trapezoidal or as a truncated pyramid, wherein the suction ducts can emerge from the base side of the truncated pyramid. Such a configuration achieves a particularly suitable air ducting involving little noise emission.

The suction ducts are preferably configured substantially in line with the suction inlet or with the aperture of the suction inlet. Preferably the pivoting or rotation axis for the suction arms passes substantially at least in sections through the suction intake or suction duct.

In order to achieve sufficient stability of the rotating suction arms, the suction ducts are in particular configured substantially rigid and in particular completely rigid or stable, so that in particular when received directly at the suction ducts, the suction arms offer a sufficiently stable support for the suction arms.

Preferably, the suction ducts show a rounded or round outer contour, at least in sections.

While the vacuum cleaner assembly is in use, the suction ducts are preferably positioned substantially upright on the floor, so that the suction arms received thereat project to the left and right substantially transverse.

In particular at least two or exactly two suction ducts are provided, so that one suction arm may be provided on each side to the left and right. More than two, for example three suction ducts may be provided, which are preferably disposed in line. Then, the two outwardly suction ducts can be provided for receiving the suction arms, wherein one or more central suction ducts vacuum a central region in which no suction arm is provided.

The vacuum cleaner assembly according to the invention offers many advantages. A considerable advantage is that the special configuration of the suction device with the at least two suction ducts and the suction arms disposed thereat or associated therewith, provides a particularly advantageous floor nozzle for vacuum cleaners.

On the one hand, a pivotable configuration of the suction arms is achieved. Thus, it is in particular achieved, with the suction arms pivotable in two directions, that the floor nozzle can for example be inserted in a narrow gap in operation.

To this end, the suction arms swing away in an appropriate direction. It is in particular also possible to pass through a narrow gap, which constitutes an obstacle, wherein the suction arms can expand once again after passing through the obstacle. To this end, when entering into the obstacle, the suction arms swing away into one direction. After passing through the obstacle, the suction arms can reset to the base position. When the floor nozzle is pulled out of the obstacle, the suction arms swing back in the opposite direction, so that the floor nozzle can also be readily pulled out of the obstacle.

Moreover, the special arrangement and configuration of the suction device provides a very compact while also stable vacuum cleaner assembly, so that when folding in or pivoting the suction arms, particularly narrow gaps may be entered, so that the vacuum cleaner floor nozzle is particularly versatile in application.

Preferably, at least one suction arm is received at least at one suction duct. In such a configuration, the inlet duct is in particular fastened to or supported on the suction duct. Thus, the suction duct can in particular provide a rotation axis for the suction arm.

In convenient configurations, at least one suction duct is a part of at least one suction arm. Then, the suction duct is preferably fixedly connected, and/or integrally manufactured, with the suction arm. Then, the suction arm is received on the basic body, in particular rotatably by way of the suction duct.

Particularly preferably, at least one suction arm comprises at least one connecting device for accommodation on a suction duct, which comprises in particular at least one connecting sleeve and at least one pivoting sleeve rotatable thereto. Thus, the suction arm can for example be pushed onto the suction duct by means of the connecting sleeve, so as to provide a stable accommodation of the suction arm on the suction duct. The second sleeve, which is provided rotatable relative to the connecting sleeve and is in particular configured as a pivoting sleeve, achieves rotatability relative to the connecting sleeve. To this end, a sliding bearing can preferably be provided between the two sleeves, or the two sleeves can glidingly form a functional connection with one another. Other bearings may be conveniently used, for example a ball bearing may be provided. Depending on the configuration, preferably at least one connecting plate with at least one aperture and at least one connecting member may be provided to pivotally accommodate the suction arm or the suction duct at the aperture of the connecting plate. The connecting plate can then preferably be fastened to the basic body by way of the suction arms which are pivotally received thereat. In other configurations the suction arm may preferably comprise as a connecting device, a passage mated to the cross section of the suction duct, by means of which the suction arm is placed onto the suction duct. In this way, rotatability can be achieved not involving two sleeves. This is in particular useful for suction ducts showing a round cross section.

In advantageous configurations, at least one suction arm is retained in at least one initial position by means of at least one biasing device. This initial position is in particular a position retaining the suction arms in a position such that the vacuum cleaner assembly is structured similar to a conventional floor nozzle. Thus, the two suction arms preferably protrude from the basic body to the left and right.

Preferably, at least one suction arm is pivotable in at least one direction against the force of the biasing device, from the initial position to at least one pivot position. Pivotable is in particular understood to mean rotatable, wherein rotatability of up to 90° or more to one, and preferably also to the other, direction can be obtained. The suction arm resets in particular automatically by means of the biasing device, when force stops acting against the biasing device.

Particularly preferably the biasing device comprises at least one spring, at least one spring rod, at least one rubber element or rubber band or at least one rubber O-ring, and/or at least one other suitable biasing member and optionally at least one covering device. Such a spring may for example be configured as an extension spring and/or a torsion spring. Other springs or spring types can likewise be employed as a biasing device. In particular at least two springs per suction arm may be provided, thus, for example it may be useful to use two extension springs, each in particular providing a restoring force for the deflection in one direction.

In a preferred configuration with rubber elements, the restoring force or the force required for pivoting may preferably be provided by selecting the rubber elements. Thus, the user can for example select the force or strength of the rubber elements according to the requirements and demands. For example in the case of a floor covering showing comparatively high frictional resistance, selecting stronger rubber elements may be advantageous, so that the suction arms do not already rotate due to the frictional effect of the floor covering. Then the rubber elements are in particular provided freely accessible, so that the user can exchange them quickly and readily in the case of a defect or a scheduled exchange.

In convenient specific embodiments the biasing device is accommodated on the basic body and on at least one suction arm. Thus, in particular fastening at least one extension spring to the basic body and a suction arm may be advantageous. Thus, in particular fastening one or two extension springs on the top face of the suction arm is convenient, wherein the other side of the extension spring is then hooked for example in a pertaining accommodation on the basic body. In a preferred configuration, in which the biasing device comprises at least one spring rod or the like biasing member, a spring rod may for example be guided through an aperture or an eyelet-type fastener on the basic body, extending across the suction arms. Then the spring rods are preferably covered on the suction arms with a covering device, which can concurrently serve to guide the spring rods. While the suction arms are pivoting, the spring rods slide back and forth in the guides. A configuration including springs or extension springs may likewise be provided with a covering device.

In preferred configurations, at least one suction arm comprises at least one air baffle. This air baffle may be configured as a separate component or it may be incorporated in one-piece suction arms.

Preferably the suction arm and/or the air baffle comprises at least one glide device. Such a glide device is provided for facilitating movements of the vacuum cleaner assembly in particular on wall-to-wall carpeting. To this end, the glide device preferably comprises at least one glide surface. Such a glide device or glide surface may also comprise at least one fabric section, as in conventional floor nozzles. Depending on the configuration, suitably processed plastic surfaces may serve for glide surfaces.

Preferably, at least one suction arm and/or the air baffle comprises at least one air ducting in functional connection with the suction intake of the associated suction duct. It is in particular preferred for this air ducting to be configured as a duct which preferably extends at least over a substantial longitudinal extension of the suction arm. Thus, it can be achieved that air can be aspirated by means of the suction intake over nearly the entire longitudinal extension of the suction arm.

Particularly preferably, at least one suction arm comprises at least one cover. This is the case in particular with suction arms consisting of multiple components. This cover is in particular configured as a housing part, which is for example placed on, and/or e.g. screw-connected with, the air baffle from above.

Preferably at least one suction arm comprises at least one brush device, in particular including at least one brush accommodated therein and/or thereon. A circumferential brush takeup or also circumferential brushes may be provided. It is also advantageous to provide single brush sections in one circumferential brush takeup or also in single sections of brush takeups. Such a brush device is in particular advantageous for use in vacuuming hard floors, i.e. not wall-to-wall carpeting. Such a brush device can in particular be provided additionally or alternatively to a glide device or to the glide surface for vacuuming wall-to-wall carpeting.

Preferably the brush device is disposed at least in sections between the air baffle and the cover.

It is in particular preferred for the brush device to be configured for at least partial retracting and/or extending. Thus, the brush takeup or the brush is in particular displaceable, so that the user can decide, depending on the vacuumed surface, whether to use the brush device or the glide device. To this end, the brush device or the brush takeup of the brush device can be extended in particular at least far enough so that the brushes or the brush protrudes beyond the glide device or the glide surface.

In useful specific embodiments, at least one locking device for locking at least one suction arm is provided. The optional locking of suction arms can be advantageous, depending on the application. Thus, a user can advantageously block the pivotability or rotatability of one or both of the suction arms as required. In particular when vacuuming wall-to-wall carpeting, blocking the pivotability or rotatability of the suction arms can be advantageous since the frictional resistance on wall-to-wall carpeting may be strong enough for the suction arms to pivot unintentionally.

Preferably the brush device and/or the locking device comprise at least one selection device. The selection device preferably comprises at least one actuating member, for example for changing between using the brush device and the glide device, and/or for locking the suction arms. Such an actuating member can in particular be provided as a lever or shifter, which is in particular accommodated on the basic body and is for example foot-operated.

The selection device preferably comprises at least one adjustment device. The brush device or the brush takeup can be adjusted or retracted and/or extended by means of this adjustment device.

Then the adjustment device preferably comprises at least one lever shaft. In this configuration, the brush or the brush takeup is configured shell-shaped, in particular at least in sections, for the lever shaft to engage it. Then the brush takeup can be extended as required by means of the lever shaft.

Preferably, the brush device comprises at least one resetting device, which automatically retracts the brush takeup as the lever or the adjustment device respectively the lever shaft is released. Such a resetting device preferably comprises at least one biasing device, in particular at least one spring. Depending on the configuration, the brush takeup can then be extended, for example against the force of an extension spring, by means of the adjustment device or the lever shaft. As soon as the lever shaft is released, the extension spring preferably pulls the brush takeup or the spring upwardly, together with the lever shaft. Depending on the configuration, the resetting device may also comprise a compression spring, which retains the brush takeup in the retracted position. Then, the brush device can be extended again by means of the lever shaft, against the force of the compression spring.

Preferably, at least one suction arm comprises at least one end support for the adjustment device. Then, depending on the configuration, the resetting device or a spring and/or the lever shaft can in particular be guided across the end support.

Particularly preferably, at least one suction arm comprises at least one fastener between the air baffle and the cover.

The fastener is preferably part of the air baffle. Particularly preferably, the fastener serves additionally, or otherwise, as a guide and/or accommodation for the brush device or parts thereof. In useful specific embodiments the fastener serves additionally, or otherwise, as a guide for the resetting device, compression springs can in particular be fitted onto the fasteners or be guided across.

Preferably, the selection device comprises at least one shifting device. A shifting plate can in particular be provided, which is in functional connection with the adjustment device and in particular with the lever shaft. Depending on the configuration, the shifting device respectively the shifting plate is also, or solely, in functional connection with elements respectively components of the locking device.

The shifting device is in particular configured plate-like, the shifting device then preferably showing at least one recess, by means of which the shifting device is accommodated at least at one suction duct. It is in particular preferred for the shifting device to comprise at least two recesses, so that the shifting device is securely guided at least at two suction ducts.

Preferably, the shifting device comprises at least one fastening member, at least one suction arm and/or at least one suction duct comprising at least one fastening member interacting with the fastening member of the shifting device. Thus, mechanical blocking of rotary motion of the suction arms can be prevented.

Particularly preferably, the shifting device is in functional connection with the adjustment device and/or the actuating member. A direct and/or indirect functional connection between the components can in particular be given.

The adjustment device serves in particular to actuate the brush devices of the two suction arms respectively for lowering the brush takeup respectively the brushes of both of the suction arms. The adjustment device serves in particular to actuate the locking device. If a brush device and a locking device are provided, they are preferably actuated respectively operated jointly. Preferably, however, the two components can be provided alone on a vacuum cleaner nozzle.

In useful configurations, at least one transmission member is disposed between the actuating member and/or the adjustment device. Thus, for example a plunger may be provided, which provides a transmission member, the force to be transmitted from the actuating member respectively a lever or a shifter to the adjustment device respectively the shifting plate.

The vacuum cleaner according to the invention comprises a vacuum cleaner assembly as described above, and shows the same advantages.

BRIEF DESCRIPTION OF THE DRAWINGS

Further advantages and features of the present invention can be taken from the exemplary embodiments which will be discussed below with reference to the enclosed figures.

The figures show in.

DETAILED DESCRIPTION

Figure 1:
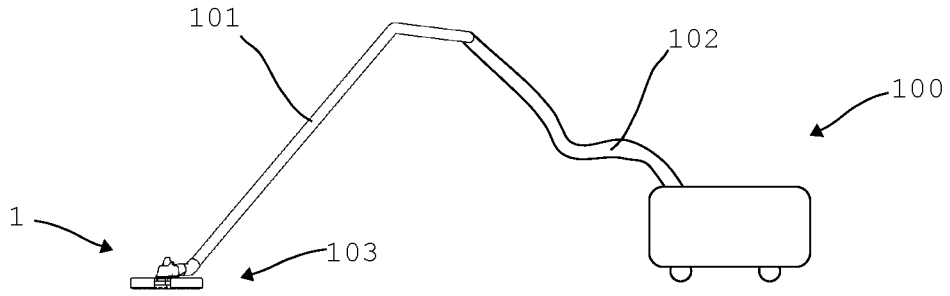
FIG. 1 a schematic illustration of a vacuum cleaner with an exemplary embodiment of a vacuum cleaner assembly according to the invention.

FIG. 1 schematically illustrates a vacuum cleaner 100 to which a vacuum cleaner assembly 1 according to the invention, which is presently configured as a floor nozzle 103, is connected by means of a suction hose 102 and a suction tube 101.

Figure 2:
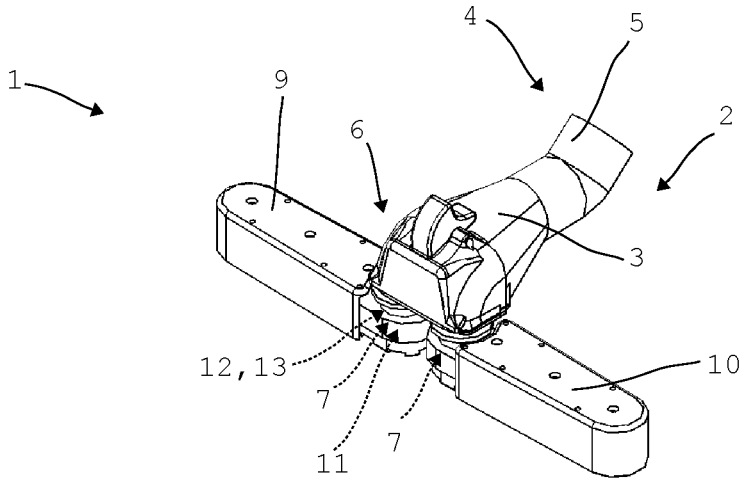
FIG. 2 a schematic illustration of an exemplary embodiment of a vacuum cleaner assembly according to the invention in a perspective view.
Figure 3:
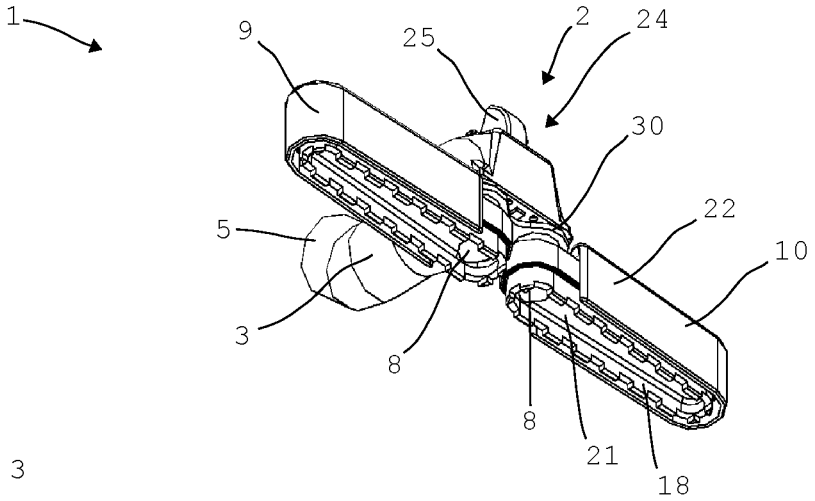
FIG. 3 the vacuum cleaner assembly according to FIG. 3 in another perspective view.
Figure 4:
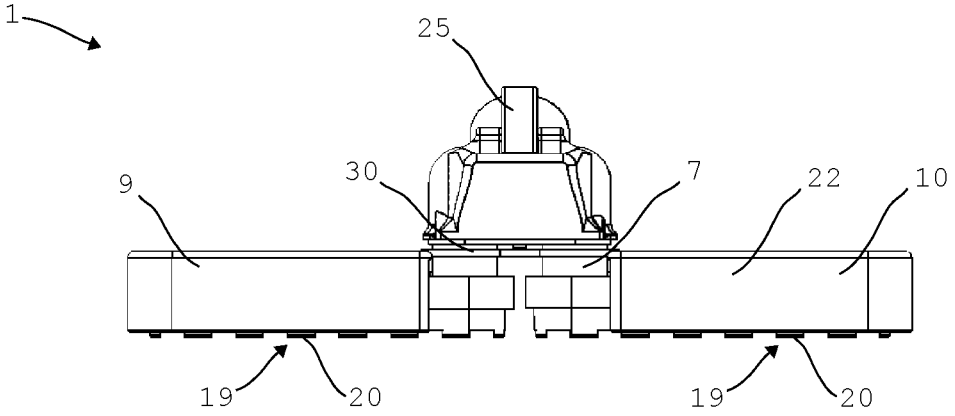
FIG. 4 the vacuum cleaner assembly according to FIG. 3 in a schematic front view.
Figure 5:
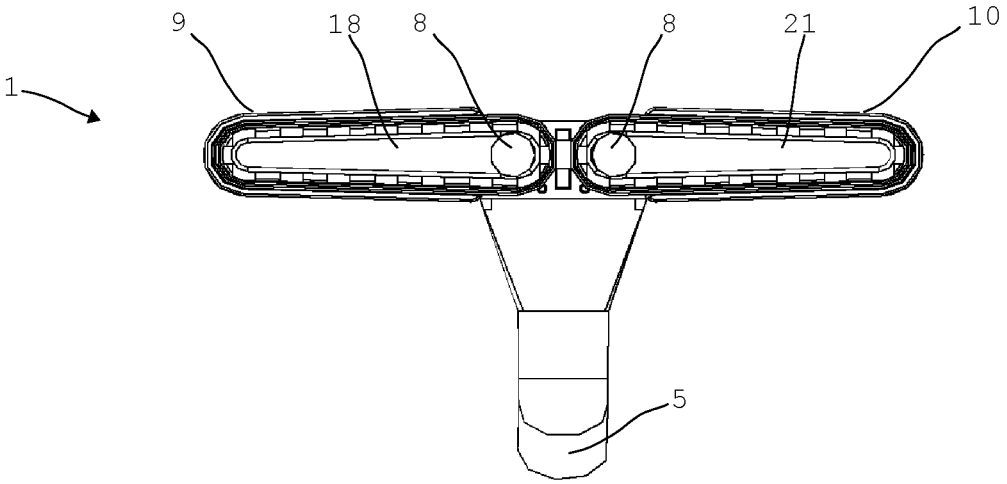
FIG. 5 the vacuum cleaner assembly according to FIG. 3 in a schematic bottom view.

The FIGS. 2 and 3 schematically illustrate an exemplary embodiment of a vacuum cleaner assembly 1 according to the invention. It can be seen that the vacuum cleaner assembly 1 respectively the floor nozzle 103 comprises a suction device 2, which comprises a basic body 3 with a first end 4. The basic body 3 is substantially hollow, the first end 4 being provided with a suction inlet 5 for connection with a suction tube 101 and/or a suction hose 102 of a vacuum cleaner 100.

The substantially hollow basic body 3 divides at a second end 6 in the exemplary embodiment shown, into two suction ducts 7, each showing a suction intake 8. In the exemplary embodiment shown, the suction arms 8, 10 are integrally manufactured with the suction tubes 7. The suction arms 9, 10 are rotatably accommodated on the basic body 3. Thus, the suction arms 9, 10 rotate around, respectively together with, the suction ducts 7.

The basic body 3 in the exemplary embodiment shown is compact respectively very slim. The slimmer the basic body 3, the better the vacuum cleaner assembly 1 can later, when in use, enter into narrow gaps, for example between furniture feet.

To this end, the suction arms 9, 10 are provided pivotable respectively rotatable around the suction ducts 7, respectively they can rotate or pivot with the suction ducts 7 relative to the basic body, so that, depending on the configuration, they can fold away as required in one and/or two directions. The smaller the basic body 3, the closer the suction device 2 can be pivoted together, even when the suction arms 9, 10 are folded in.

In the exemplary embodiment shown, the suction arms 9, 10 respectively the suction ducts 7 are connected, through a connecting device 11, with the basic body 3 respectively with a connecting plate 41 fastened to the basic body. In other configurations, the suction arms 9, 10 can be fastened differently, wherein it is in particular still preferred for the suction arms 9, 10 to be pivotable around the suction ducts 7.

In other configurations, not shown, the connecting device 11, in particular with the suction arms 7 provided non-rotatable but for example manufactured integrally with the basic body 3, can comprise a connecting sleeve 12, by means of which the suction arms 9, 10 are firmly accommodated on the suction duct 7. Then, a pivoting sleeve 13 is preferably provided rotatable, which may be suitably supported for pivoting respectively rotation relative to the connecting sleeve 12. Other, rotary attachments of the suction arms directly on a suction duct may also be advantageously provided.

The FIGS. 4 to 7 illustrate respectively a front view, a bottom view, a top view, and a side view, of an exemplary embodiment of a vacuum cleaner assembly 1 according to the invention. Again one can see that the basic body 3 of the suction device 2 of the vacuum cleaner assembly 1 according to the invention, pivotally accommodates two suction arms 9, 10 on a suction duct 7 each, respectively by means of the suction duct 7.

The suction arms 9, 10 in the exemplary embodiment shown are constructed of multiple components. Each of these suction arms 9, 10 comprises an air baffle 18 comprising an air ducting 21 in functional connection with the pertaining suction intake 8 of the corresponding suction duct 7. Thus, in the exemplary embodiment shown, aspiring air through the suction intake 8 can generate a suction flow over nearly the entire longitudinal extension of the suction arms 9, 10.

In the exemplary embodiment shown, the suction arms 9, 10 comprise a glide device 19 comprising multiple glide surfaces 20, by means of which the vacuum cleaner assembly 1 respectively the floor nozzle can be readily pushed over the floor, in particular glide over wall-to-wall carpeting. Other than the air baffle 18, each suction arm 9, 10 in the exemplary embodiment shown also comprises a brush device 23 and a cover 22.

Figure 6:
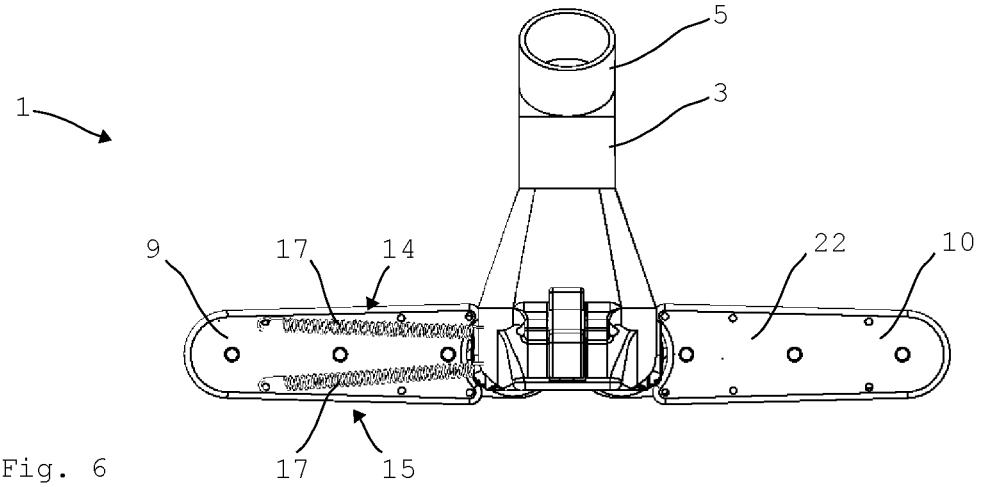
FIG. 6 the vacuum cleaner assembly according to FIG. 3 in a schematic top view.
Figure 7:
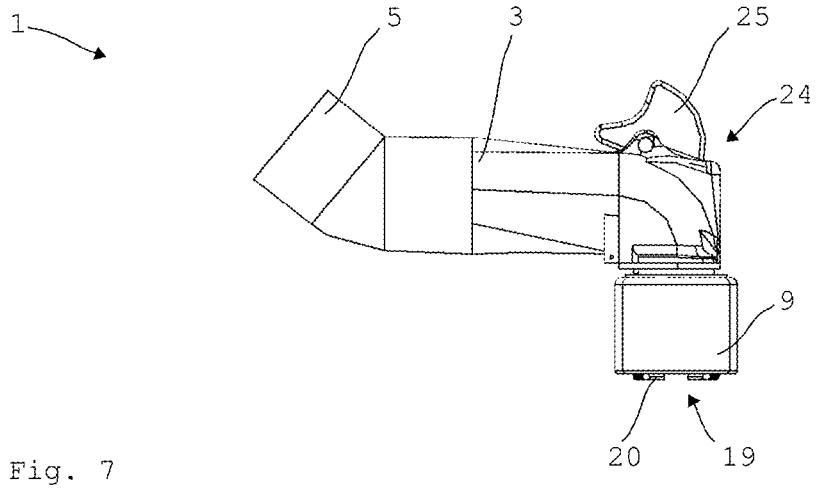
FIG. 7 the vacuum cleaner assembly according to FIG. 3 in a schematic side view.
Figure 8:
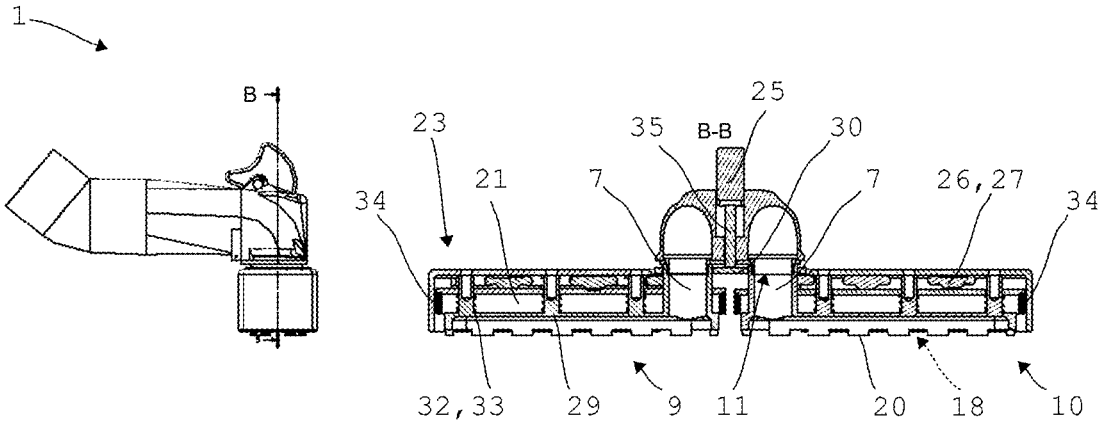
FIG. 8 a schematic illustration of an exemplary embodiment of a vacuum cleaner assembly according to the invention in a schematic side view and in a sectional view.
Figure 9:
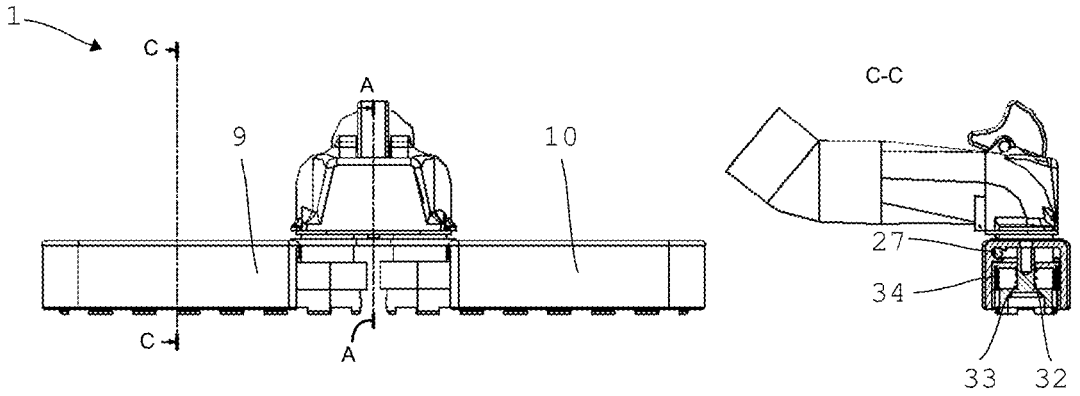
FIG. 9 the vacuum cleaner assembly according to FIG. 8 in a schematic front view and a sectional view.
Figure 10:
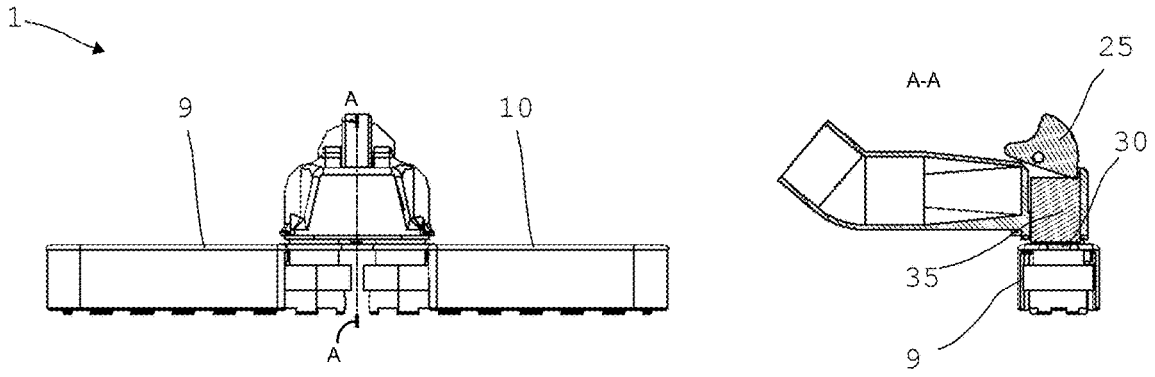
FIG. 10 the vacuum cleaner assembly according to FIG. 8 in another schematic front view and a sectional view.
Figure 11:
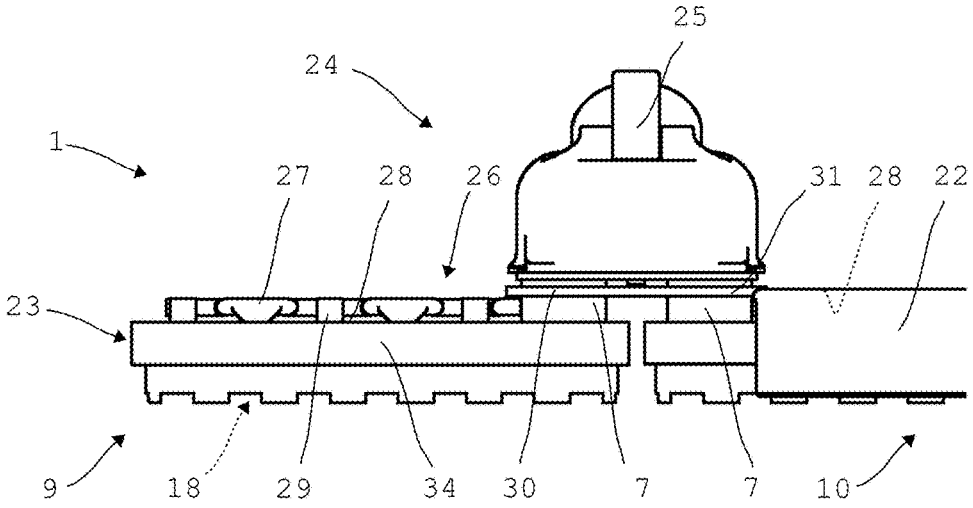
FIG. 11 a schematic illustration of an exemplary embodiment of a vacuum cleaner assembly according to the invention, with a view on the adjustment device with the brush takeup retracted.
Figure 12:
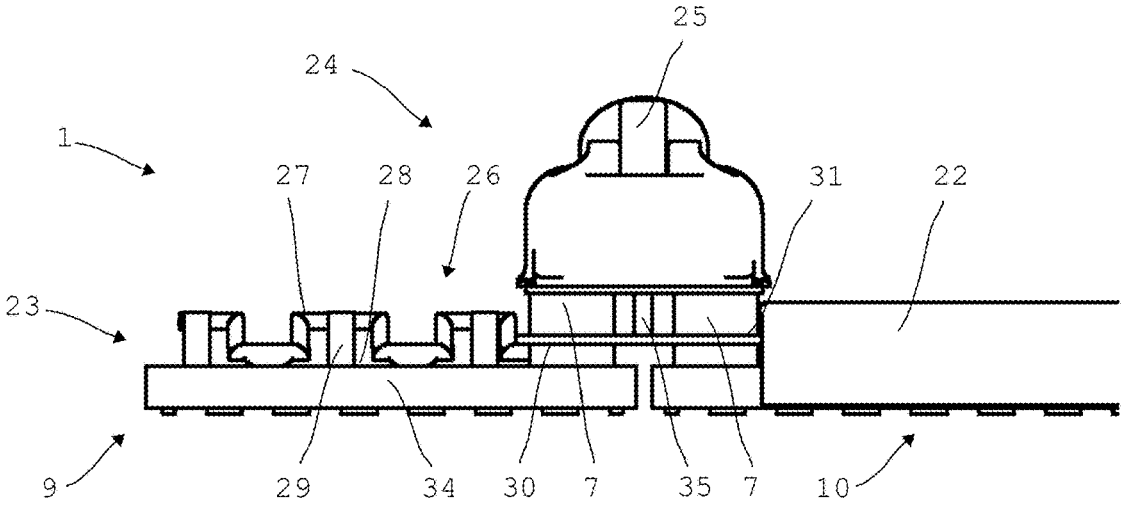
FIG. 12 the view according to FIG. 11 with the brush takeup extended.

In FIG. 6, which schematically illustrates a top plan view of a vacuum cleaner assembly 1 according to the invention, it is schematically shown by the suction arm 9 that a biasing device 14 can be associated with each of the suction arms 9, 10. In the exemplary embodiment shown it comprises two springs respectively two extension springs 17.

The suction arm 9 is retained on one side in an initial position 15 by means of such a biasing device 14. The pertaining suction arm 9, 10 can be rotated respectively pivoted in the corresponding direction against the force of the biasing device 14. When the force acting against the biasing device 14 is removed, the pertaining suction arm 9, 10 resets automatically due to the force of the biasing device 14 respectively the extension spring 17.

In an embodiment not shown, rubber elements can be employed instead of the extension springs 17. Then, these rubber elements can preferably be provided in various strengths respectively with different restoring forces, so that a user can adjust the forces required for pivoting the suction arms 9, 10 according to his requirements, by selecting suitable rubber elements.

The FIGS. 8 to 12 schematically illustrate in various views that in the exemplary embodiment shown, the vacuum cleaner assembly respectively the suction device 2 also comprises a brush device 23, which can optionally be extended and retracted as required.

In the exemplary embodiment shown the brush device 23 comprises a brush takeup 34 in which at least one brush, not shown in detail, can be inserted. The brush takeup and/or the brush can be configured peripherally around the air ducting 21 and/or can be provided in sections only.

The brush device 23 is provided in particular for use on hard floors, such as for example tiles or wood flooring or laminates. Then the brush device 23 can be activated or retracted by means of an actuating member 25, as required.

This actuating member 25 is a part of a selection device 24 comprising, other than the actuating member 25 in the exemplary embodiment shown, an adjustment device 26 as well. This adjustment device 26 comprises a lever shaft 27 which is guided over an end support 28. In the exemplary embodiment shown, the end support 28 is a fastener 29 connecting the cover 22 with the air baffle 18.

Thus, it is in particular also possible that, as provided in the exemplary embodiment shown, the brush device 23 is disposed at least partially between the air baffle 18 and the cover 22.

Outside respectively on the basic body 3, an actuating member 25 respectively shifter respectively lever is provided, by means of which the adjustment device 26 can be actuated. In the exemplary embodiment shown, a shifting device 30 is provided therefor, which is configured plate-like, showing two recesses 31 by means of which the shifting device 30 is accommodated at the two suction ducts 7.

In the exemplary embodiment shown, actuating the actuating member 25 by means of a transmission member 35 actuates the adjustment device 26 respectively the shifting device 30. The shifting device 30 is configured such that the brush devices 23 respectively the brush takeup 34 of both of the suction arms 9, 10 are extended respectively retracted simultaneously.

For reversing respectively retracting the brush takeup 34, the brush device comprises a resetting device 32 comprising multiple springs 33. Against the force of the springs 33, configured as compression springs, respectively the resetting device 22, the adjustment device 26 respectively the lever shaft 27 extends downwardly, whereby the brush takeup 34 is displaced downwardly.

When due to actuating the actuating member 25 the lever shaft 27 is released, the springs 33 urge the brush takeup 34 back to the initial position, moreover entraining the lever shaft 27 upwardly.

The FIGS. 13 to 16 schematically illustrate how the two suction arms 9, 10 can be pivoted relative to the basic body 3 around the suction ducts 7, respectively by way of rotating the suction ducts 7 relative to the basic body.

Figure 13:
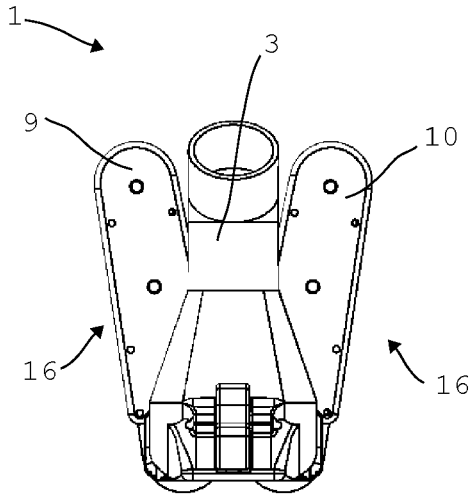
FIGS. 13 to 16 various pivot positions of the suction arms of a vacuum cleaner assembly according to the invention in top views.

FIG. 13 schematically illustrates that the two suction arms 9, 10 can be pivoted rearwardly at the same time. Thus, the suction arms 9, 10 are displaced together from an initial position 15 to a specific pivot position 16.

Figure 14:
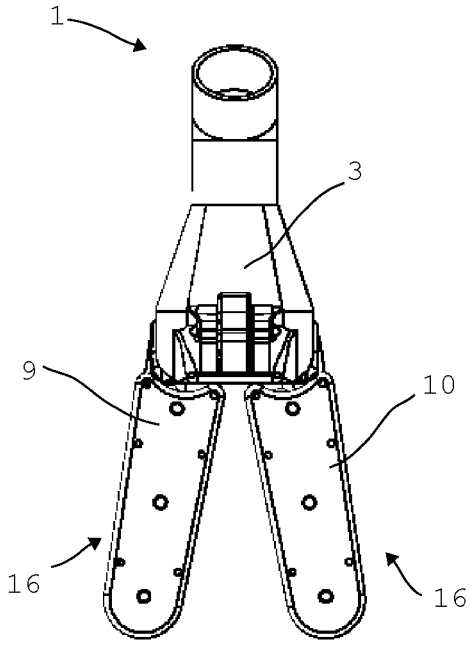

FIG. 14 schematically illustrates that two suction arms 9, 10 can also be pivoted forwardly.

Figure 15:
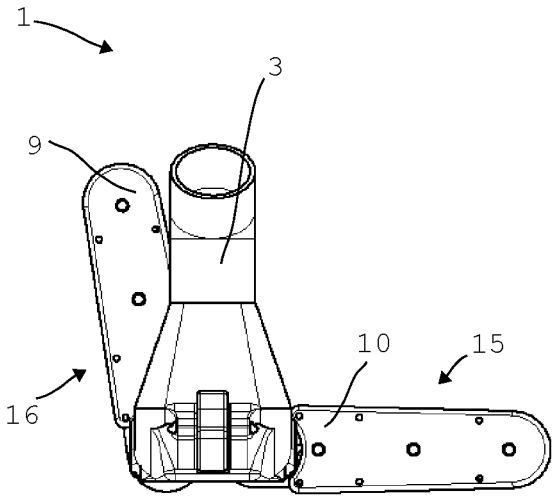

FIG. 15 schematically illustrates that the two suction arms 9, 10 can also pivot in different directions independently of one another and/or that a suction arm 10 remains in a base position 15 while a suction arm 9 is being transferred to a pivot position 16.

Figure 16:
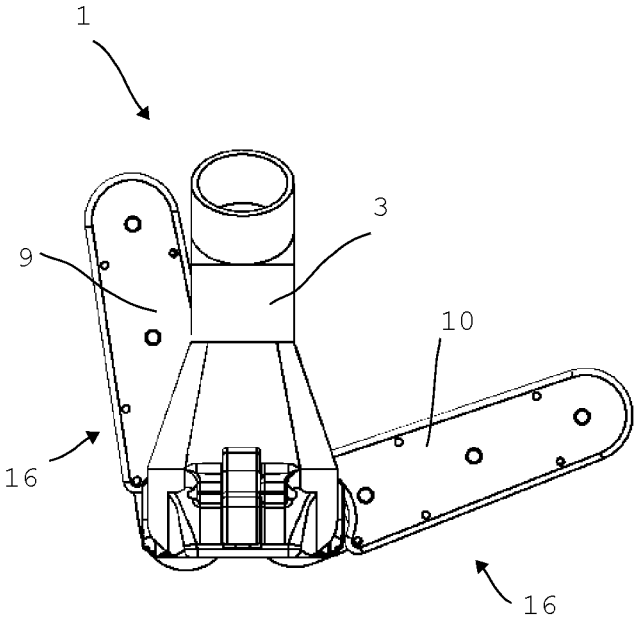

FIG. 16 schematically illustrates that a suction arm 9 can for example be completely displaced rearwardly, wherein the other of the suction arms 10 can pivot inwardly just slightly, depending on the obstacle to be passed.

Figure 17:
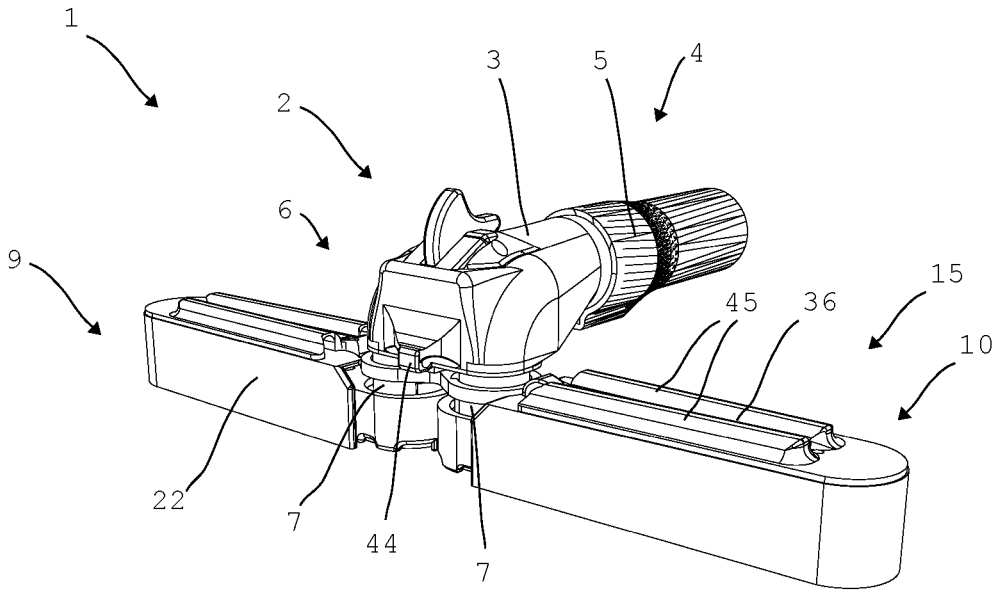
FIG. 17 a schematic illustration of another exemplary embodiment of a vacuum cleaner assembly according to the invention in a perspective view.
Figure 18:
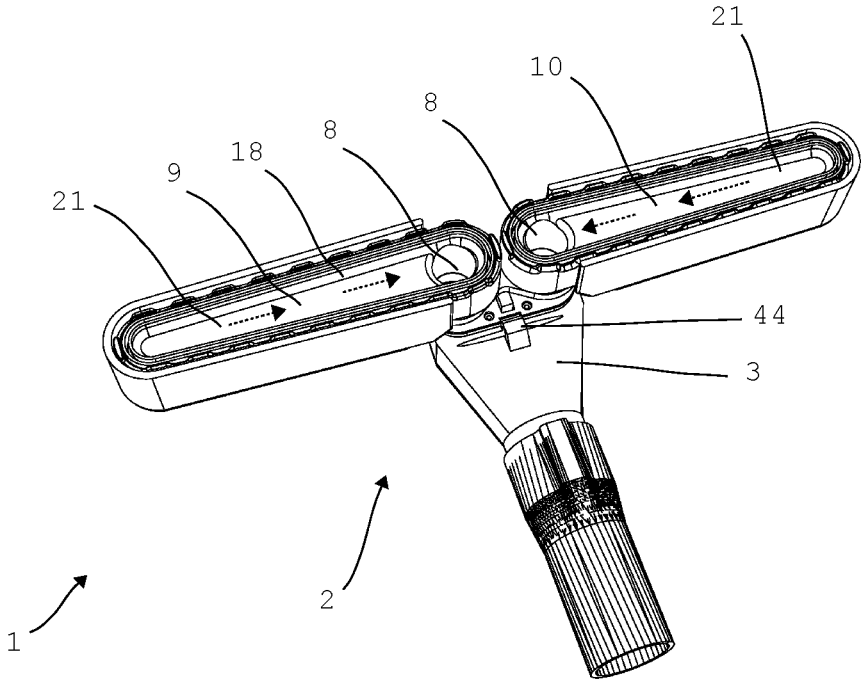
FIG. 18 the vacuum cleaner assembly according to FIG. 17 in another perspective view.

The FIGS. 17 and 18 schematically illustrate another exemplary embodiment of a vacuum cleaner assembly 1 according to the invention with a suction device 2. The vacuum cleaner assembly 1 shown is substantially structured as is the exemplary embodiment described above.

The vacuum cleaner assembly 1 comprises a basic body 3 with a first end 4 with a suction inlet 5 for connecting with the suction tube 101 respectively a suction hose 102 of a vacuum cleaner 100.

In the exemplary embodiment 2 shown, a front, second end 6 of the basic body 3 is also provided with suction ducts 7 manufactured integrally with the suction arms 9, 10 respectively with the air baffles 18 of the suction arms 9, 10. The suction ducts 7 have a suction intake 8 each, which makes a transition into the air ducting 21 of the air baffles 18 of the suction arms 9, 10, so that dirt is collected and sucked into the suction intakes 8 substantially over the entire longitudinal extension of the suction arms 9, 10.

The biasing device 14 for retaining the suction arms 9, 10 in the initial position 15 respectively for returning the suction arms 9, 10 to the initial position 15 is not illustrated in the FIGS. 17 and 18. However, unlike the exemplary embodiment described above, two spring rods 37 are provided instead of the extension springs 17.

One spring rod 37 each is guided through on the front and rear through a provided takeup 44. Then, the two ends of the pertaining spring rod 37 are guided over the suction arms 9, 10. The covers 22 of the suction arms 9, 10 are provided with another covering device 36 each, in which the ends of the spring rods 37 are received. When the suction arms 9, 10 pivot, the spring rods 37 glide back and forth in the ducts respectively guideways 45 of the covering device 36, depending on the direction in which the suction arms 9, 10 are guided, respectively on whether the suction arms 9, 10 are moved from the initial position 15 to the pivot position 16 or vice versa.

Figure 19:
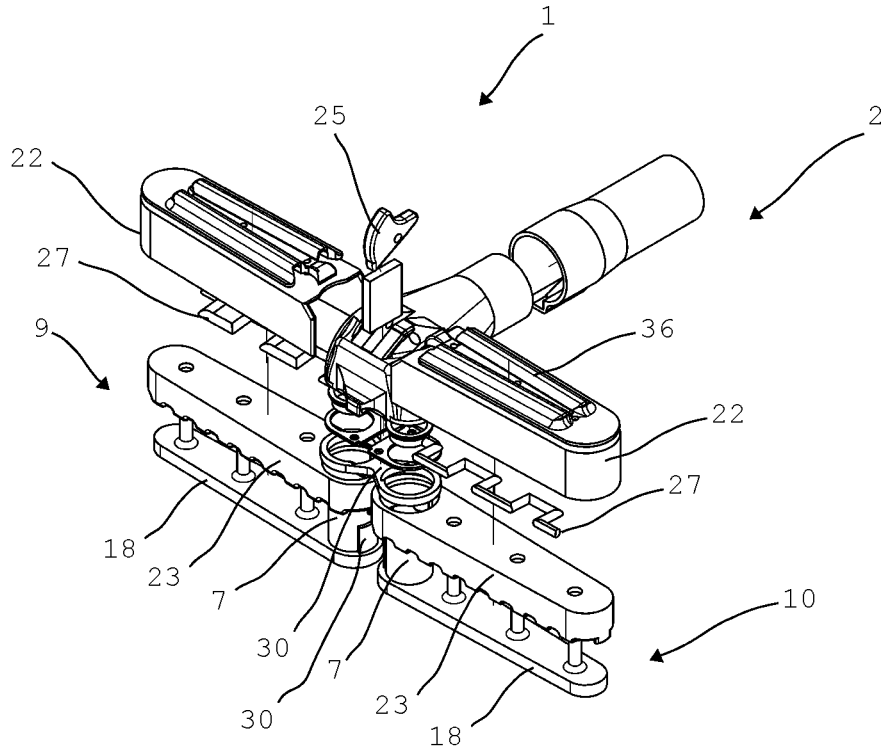
FIG. 19 a schematic illustration of the exemplary embodiment according to FIG. 17 in an exploded view.
Figure 20:
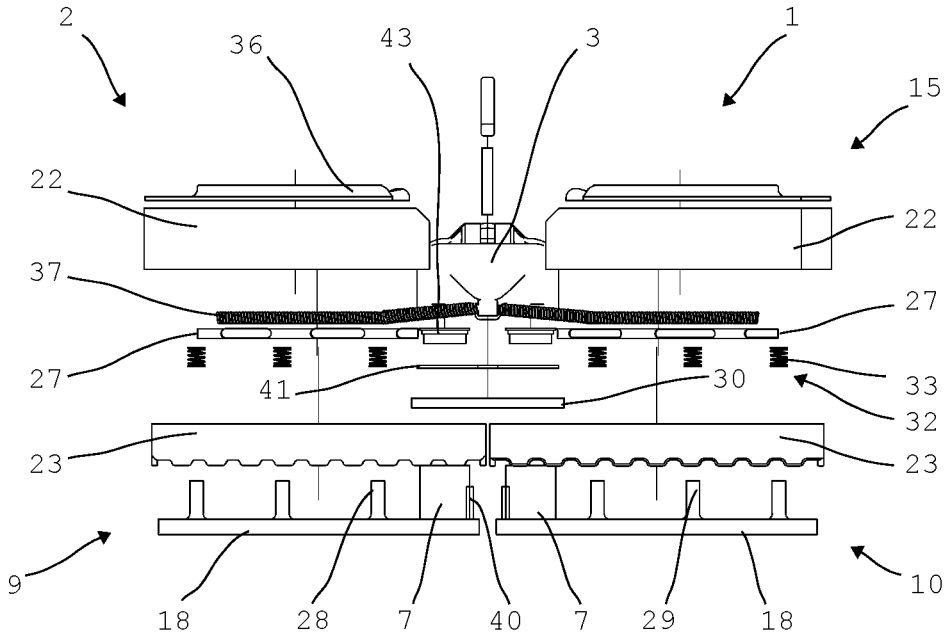
FIG. 20 another schematic illustration of the exemplary embodiment according to FIG. 17 in an exploded view with further components.

The FIGS. 19 and 20 schematically illustrate an exploded, perspective view and an exploded, front view of the exemplary embodiment shown in the FIGS. 17 and 18.

FIG. 20 also illustrates the spring rods 37 of the biasing device 40 and the springs 33 of the resetting device 32.

Figure 21:
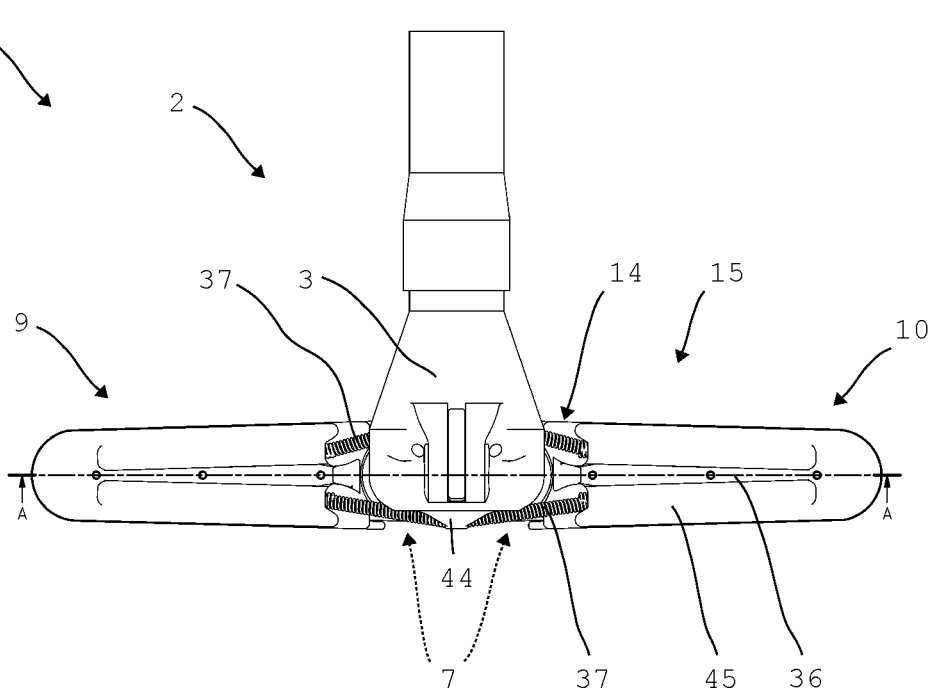
FIG. 21 a schematic illustration of an exemplary embodiment of a vacuum cleaner assembly according to the invention in a top view, FIG. 22 a schematic sectional view of the vacuum cleaner assembly according to FIG. 21 along the sectional plane A-A.

FIG. 21 is a schematic view from above of an exemplary embodiment according to the invention of a vacuum cleaner assembly 1. Again, one can recognize the spring rods 37 of the biasing device 14, which are guided into the guides respectively ducts 45 of the covering device 36.

Figure 22:
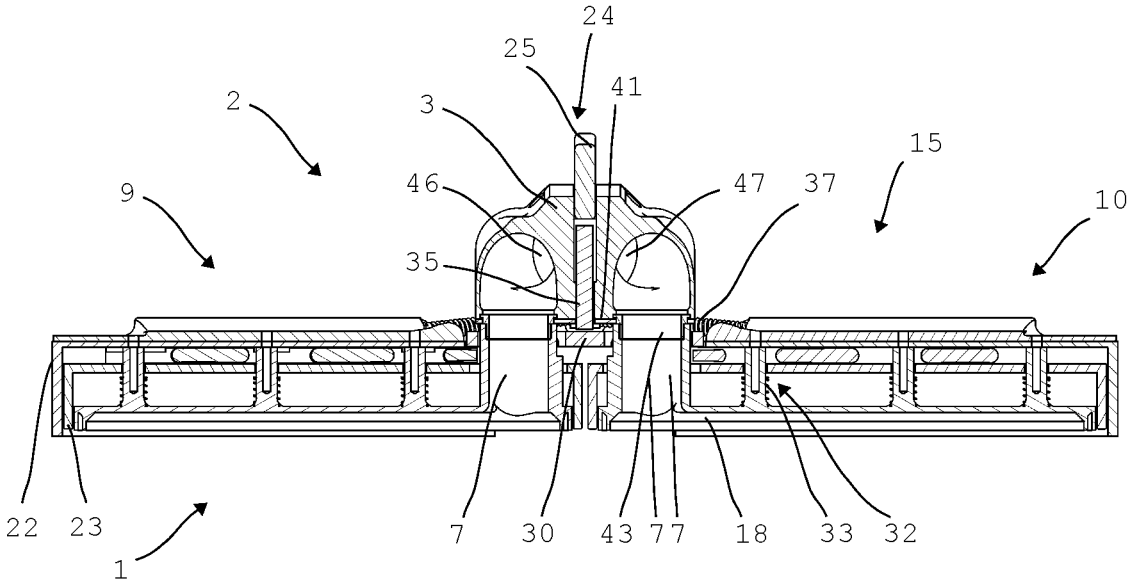

FIG. 22 shows a front sectional view of the sectional plane A-A outlined in FIG. 21. Again, one recognizes the structure of the vacuum cleaner assembly 1, wherein in particular the layout of each of the components relative to one another, such as the air baffle 18, the brush device 23 and the cover 22, can be readily recognized in the sectional view.

This sectional view also permits to recognize that in the exemplary embodiment shown the suction ducts 7 are associated, respectively integrally manufactured, with the air baffle 18.

In order to achieve a rotary accommodation of the suction ducts 7 on the basic body 3, connection members 43 are provided which connect the suction ducts 7 and thus the suction arms 9, 10 with a connecting plate 41. Then, this connecting plate 41 is connected with the basic body 3. Other configurations may also provide for another configuration respectively connection of the suction ducts 7.

It can further be seen that inside of the basic body 3, the air ducting of the suction ducts 7 continues in two separate ducts 46 and 47, so as to leave space between these two ducts 46, 47 for providing the selection device 24 respectively for the actuating member 25 and the transmission member 35.

Figure 23:
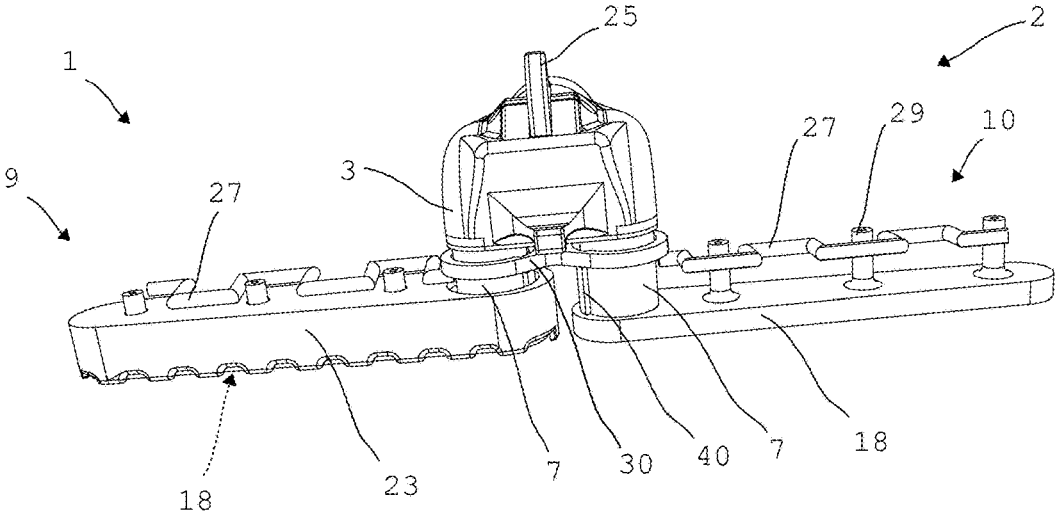
FIGS. 23-27 various schematic views of an exemplary embodiment of a vacuum cleaner assembly according to the invention with different component arrangements in perspective illustrations.

FIG. 23 schematically illustrates a perspective view of the exemplary embodiment already shown above, of a vacuum cleaner assembly 1 according to the invention, wherein various components have been hidden to better illustrate the structure of the suction device 2 at the suction arms 9, 10.

One can see by the suction arms 10 that the basic component of the suction arm 10 is the air baffle 18 with the air ducting 21, with the suction duct 7 fastened to this component, respectively the air baffle 18 and the suction duct 7 are manufactured integrally.

Again, one can identify the fasteners 29, which, among other things, serve to guide respectively receive the brush device 23, and on which moreover the springs 33 for the resetting device 32 can be retained.

As has been described above for the first exemplary embodiment, the exemplary embodiment shown also provides for a lever shaft 27 to press the brush device 23 down against the force of the resetting device 32 respectively against the force of the springs 33 of the resetting device 32.

This is done by turning over the actuating member 25. Thus, the shifting device 30 is pressed down so as to move the lever shaft 27. The lever shaft 27 pushes off against the brush device 23 and the inside surface of the cover 22 acting as the end support 28, so that the brush device 23 moves downwardly.

The exemplary embodiment shown is moreover provided with a locking device 38, which blocks the pivotability of the suction arms 9, 10, in parallel to the movements of the brush device 23.

In the exemplary embodiment shown this is provided to prohibit the pivoting of the suction arms 9, 10 when the brush device 23 is used for example in vacuuming wall-to-wall carpeting. This may be advantageous since, depending on the configuration, the frictional resistance on wall-to-wall carpeting may be that high that the suction arms 9, 10 move unintended.

The locking device 38 comprises different fastening members 39, 40, wherein the fastening members 39, 40 are presently provided on the shifter device 30 and the suction ducts 7. The precise operating principle will be discussed in more detail in the following figures.

Figure 24:
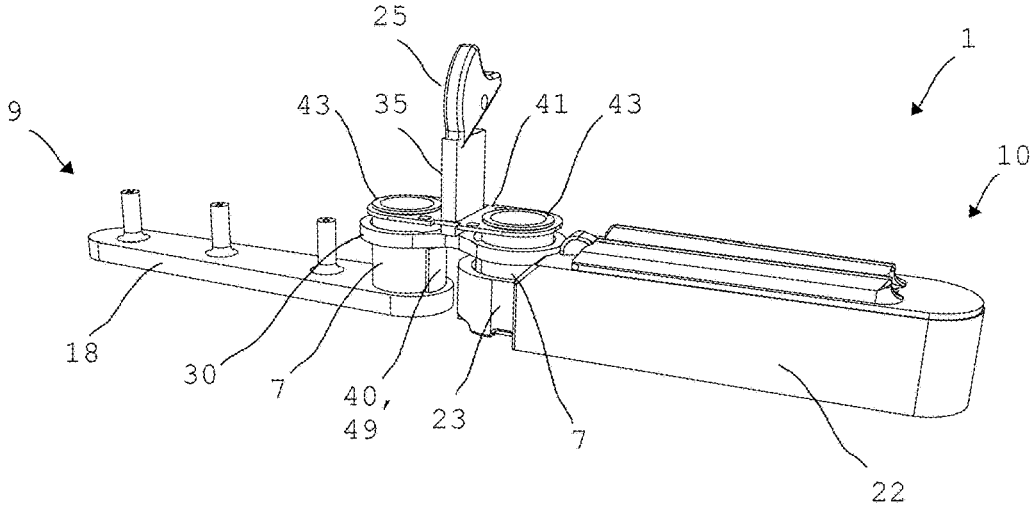

FIG. 24 illustrates the exemplary embodiment shown above, with other components. One can see that the suction ducts 7, presently manufactured integrally with the suction arms 9, 10, pass through recesses 31 in the shifting device 30. Moreover one can see that the suction arms 9, 10 respectively the suction ducts 7 are rotatably received on a connecting plate 41.

Figure 25:
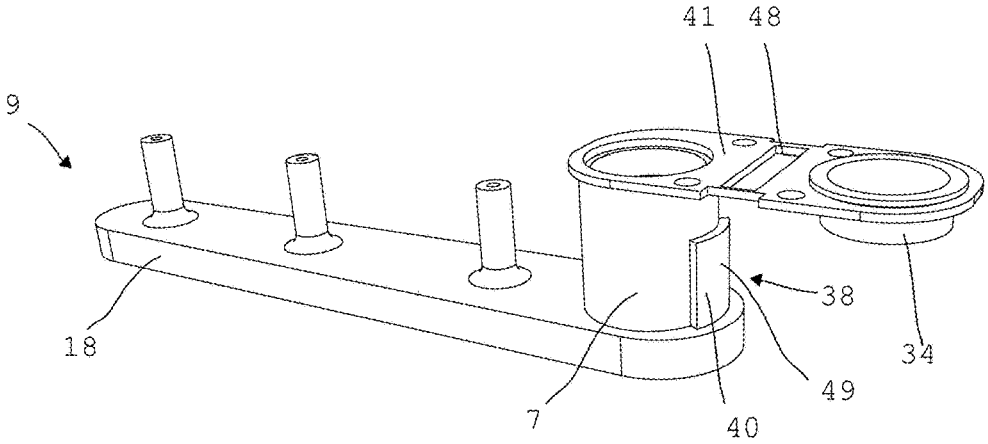

FIG. 25 shows in another perspective view how the suction arms 9, 10 respectively the suction ducts 7 are connected with the connecting plate 41. To this end, the suction ducts 7 are connected with connection members 43, which pass through apertures 42 in the connecting plate 41. This achieves a rotary attachment of the suction ducts 7 to the connecting plate 41. Then the connecting plate 41 is attached to the basic body 3.

Moreover, one can see in the view shown that a recess 48 is provided in the connecting plate 41 through which the transmission member 35 can reach.

Figure 26:
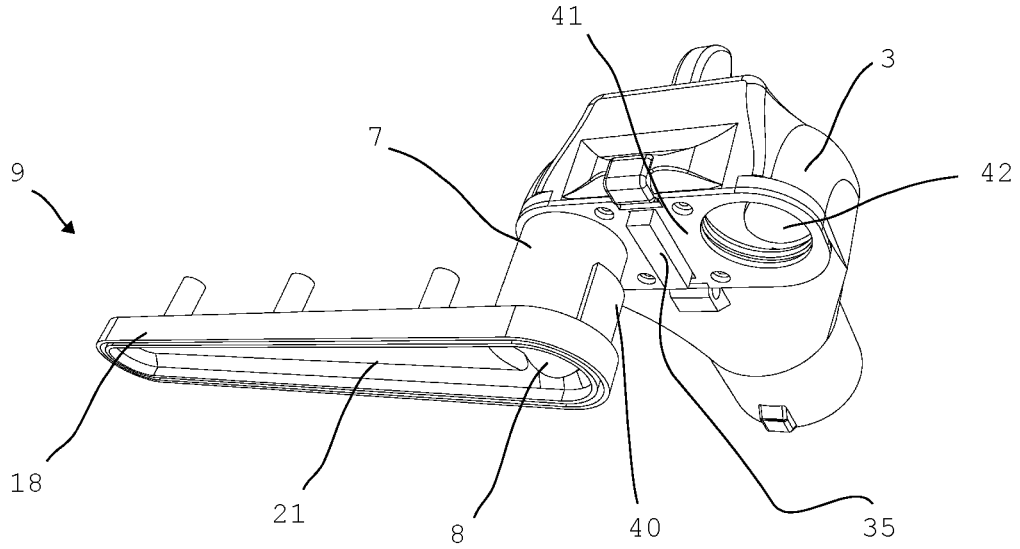
Figure 27:
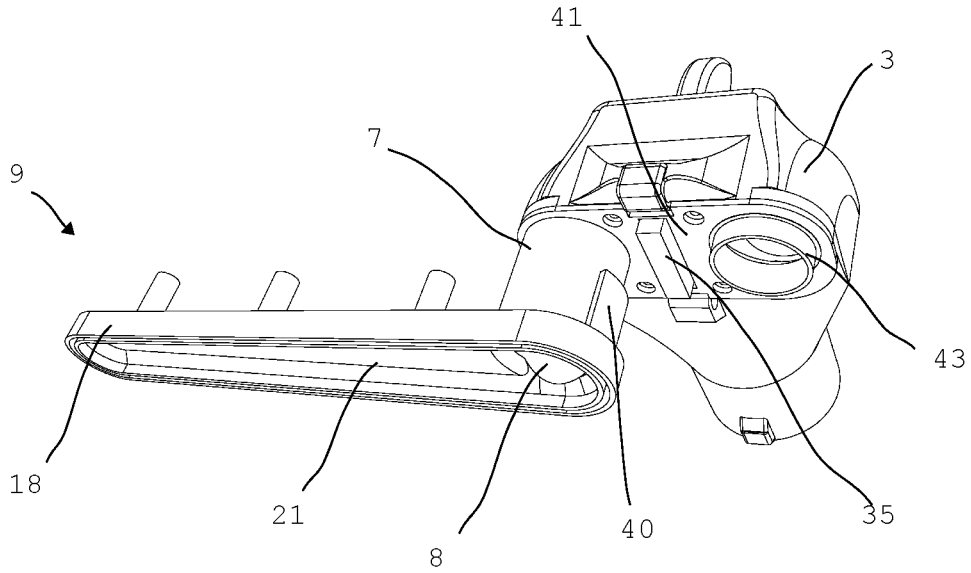

The rotary attachment of the suction arms 9, 10 respectively the suction ducts 7 to the basic body 3 with the connecting plate 41 is illustrated once again in the FIGS. 26 and 27.

Figure 28:
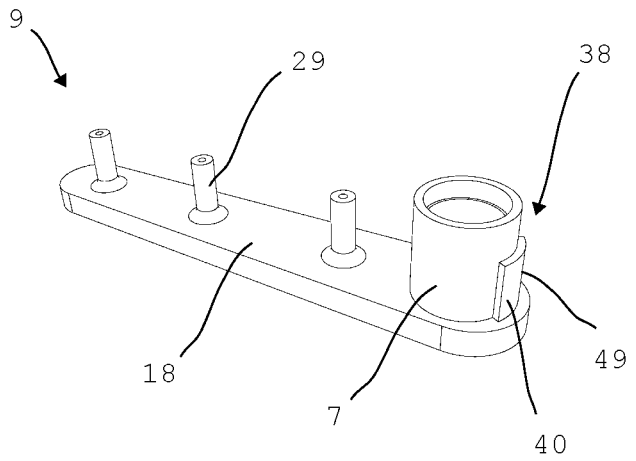
FIG. 28 a schematic illustration of a suction arm of an exemplary embodiment of a vacuum cleaner assembly according to the invention in a perspective view.

FIG. 28 schematically illustrates a suction arm respectively an air baffle 18. Again, one can see that the air baffle 18 is manufactured integrally with the suction duct 7.

Moreover, it is shown in this view how the locking device 38 is configured in the exemplary embodiment shown. In order to prevent rotation of the suction arms 9, 10, the locking device 38 can serve to mechanically block a twisting of the suction arms 9, 10. To this end, the locking device 38 comprises in the exemplary embodiment shown, a fastening member 40 attached to the suction duct 7. This fastening member 40 is configured as a step 49.

Figure 29:
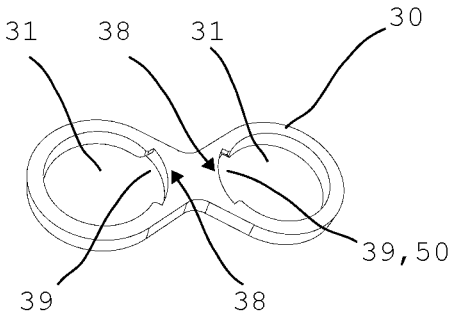
FIG. 29 a schematic illustration of a shifting device of an exemplary embodiment of a vacuum cleaner assembly according to the invention in a perspective view.

FIG. 29 schematically illustrates an embodiment of a shifting device 30 of a selection device 24. It can be seen that the shifter device 30 comprises recesses 31 through which these suction ducts 7 are guided. Thus, the shifting device 30 is guided along the suction ducts 7.

In the exemplary embodiment shown, this shifting device 30 serves on the one hand for displacing the brush device 23, on the other hand in parallel, also for locking the suction arms 9, 10. In other configurations, only locking the suction arms 9, 10 may be provided. Then, for example the lever shaft 27 and all the components of the brush device 23 may be omitted.

For locking the suction arms 9, 10, the shifting device 30 in the exemplary embodiment shown comprises fastening members 39, presently provided as recesses 50, which engage in the steps 49 respectively the fastening members 40 at the suction ducts 7 when the shifting device 30 travels downwardly. Thus, the fastening members 40 of the suction ducts 7 interlock with the fastening members 39 of the shifting device 30, so that the suction arms 9, 10 are prevented from pivoting.

Figure 30:
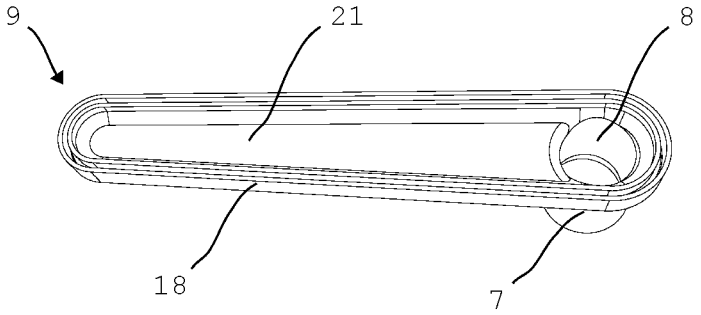
FIG. 30 a schematic illustration of the suction arm according to FIG. 28 in another perspective view.

FIG. 30 once again illustrates from beneath, the air baffle 18 according to FIG. 28. One recognizes the air ducting 21 in the direction of the suction intake 8 in the suction ducts 7.

Figure 31:
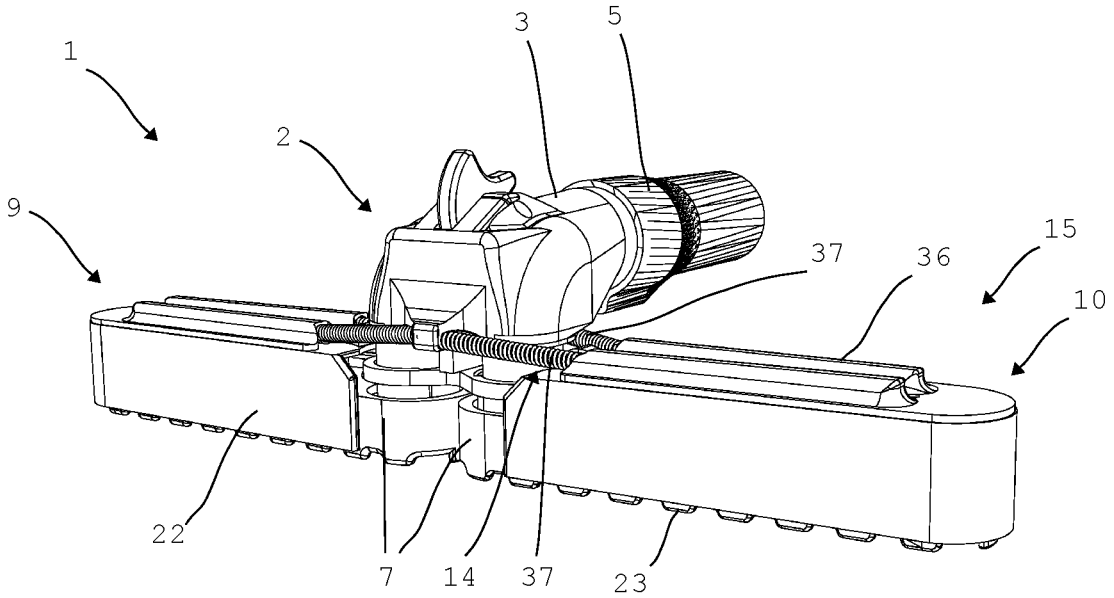
FIG. 31 a schematic illustration of an exemplary embodiment of a vacuum cleaner assembly according to the invention with the brush device extended in a perspective view.

FIG. 31 illustrates a perspective total view of the previously shown exemplary embodiment of a vacuum cleaner assembly 1 according to the invention. In the exemplary embodiment shown, the spring rods 37 of the biasing device are also included.

Unlike the embodiments shown above, the selection device 24 has been actuated to extend the brush device 23 and to lock the suction arms 9, 10 by means of the locking device 38.

Figure 32:
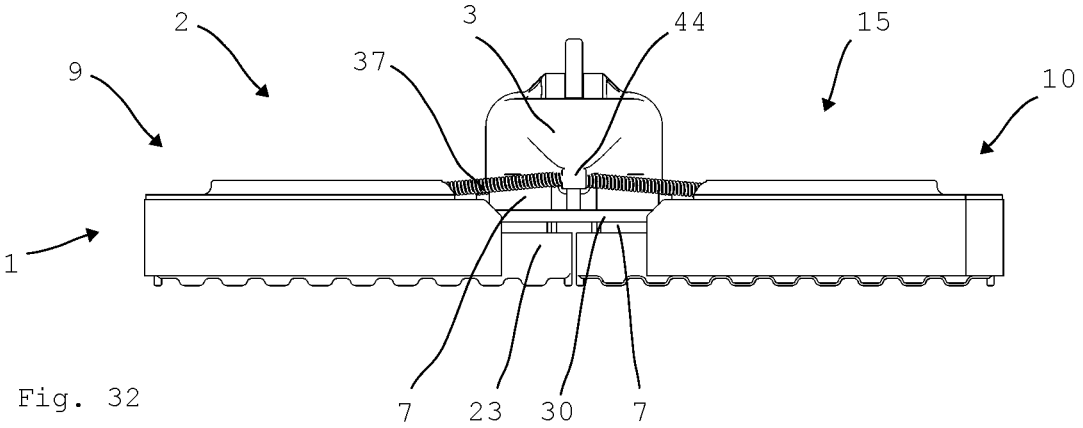
FIG. 32 the vacuum cleaner assembly according to FIG. 31 in a schematic front view.

FIG. 32 schematically illustrates the exemplary embodiment shown in FIG. 31 of a vacuum cleaner assembly in a front view.

Figure 33:
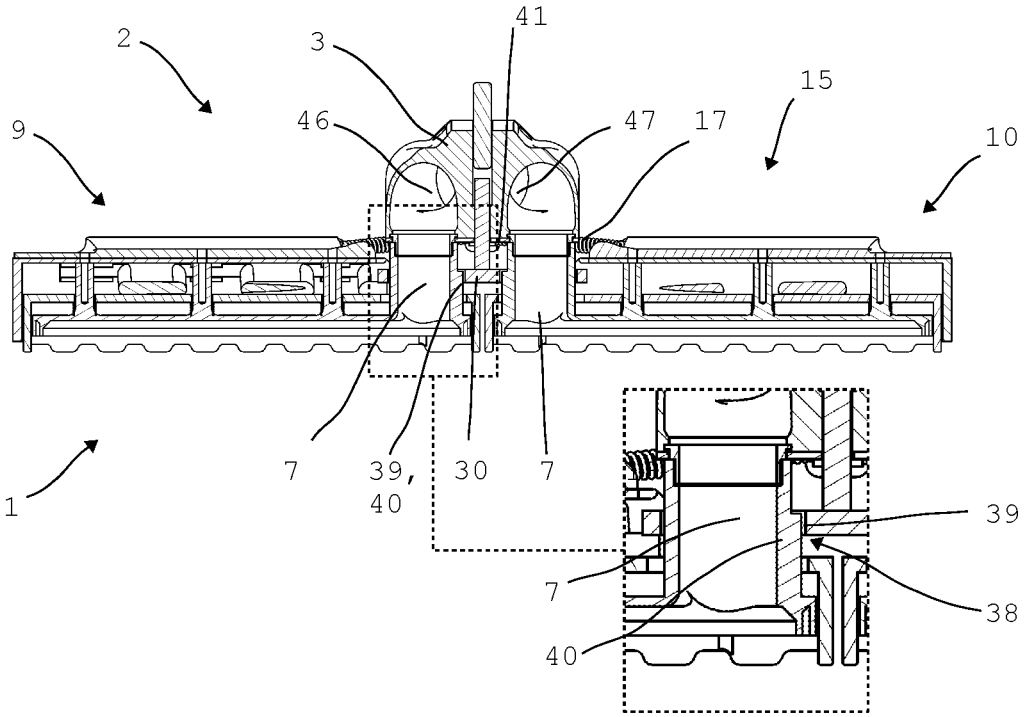
FIG. 33 the vacuum cleaner assembly according to FIG. 31 in a schematic sectional view.

FIG. 33 shows a front sectional view of the vacuum cleaner assembly 1 according to FIG. 32. Again, one recognizes the arrangement of the individual components of the vacuum cleaner assembly 1 according to the invention.

The enlargement allows to recognize how the locking device 38 respectively the shifting device 30 prevents pivoting of the suction arms 9, 10 by engagement of the fastening members 39, 40.

Figure 34:
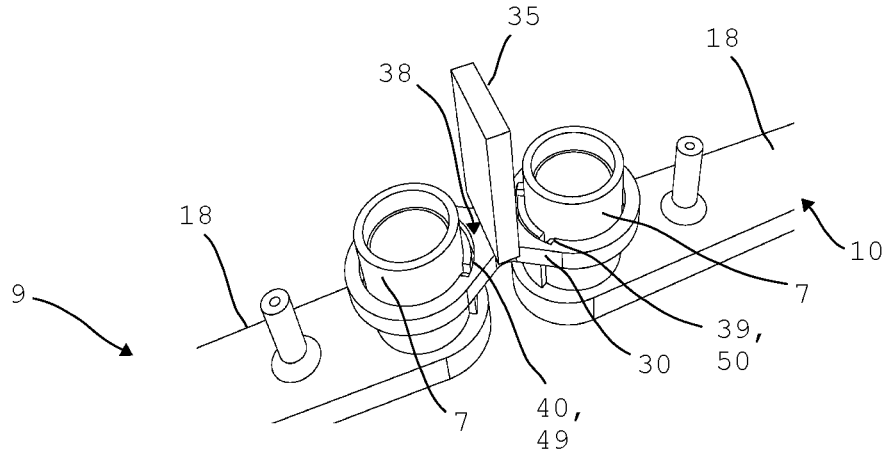
FIG. 34 a schematic, enlarged illustration of the operating principle of a locking device in a perspective view.

FIG. 34 schematically illustrates in a perspective view the operating principle of the locking device 38. The transmission member 35 travels downwardly by way of the actuating member 25 (not shown), so that the shifting device 30 also travels downwardly.

The shifting device 30 is provided with a fastening member 39, which is provided by another recess 50 in the recess 31.

The suction ducts are provided with fastening members 40, presently configured as steps 49. The shifting device 30 is displaced along the suction ducts 7, until the fastening members 39, 40 interlock, thus blocking the suction arms 9, 10.

While particular embodiments of the present vacuum cleaner assembly have been described herein, it will be appreciated by those skilled in the art that changes and modifications may be made thereto without departing from the invention in its broader aspects and as set forth in the following claims.

| List of reference numerals: | |
|---|---|
| 1 | vacuum cleaner assembly |
| 2 | suction device |
| 3 | basic body |
| 4 | first end |
| 5 | suction inlet |
| 6 | second end |
| 7 | suction duct |
| 8 | suction intake |
| 9 | suction arm |
| 10 | suction arm |
| 11 | connecting device |
| 12 | connecting sleeve |
| 13 | pivoting sleeve |
| 14 | biasing device |
| 15 | initial position |
| 16 | pivot position |
| 17 | spring/extension spring |
| 18 | air baffle |
| 19 | glide device |
| 20 | glide surface |
| 21 | air ducting |
| 22 | cover |
| 23 | brush device |
| 24 | selection device |
| 25 | actuating member |
| 26 | adjustment device |
| 27 | lever shaft |
| 28 | end support |
| 29 | attachment member |
| 30 | shifting device |
| 31 | recess |
| 32 | resetting device |
| 33 | spring |
| 34 | brush takeup |
| 35 | transmission member |
| 36 | covering device |
| 37 | spring rod |
| 38 | locking device |
| 39 | fastening member |
| 40 | fastening member |
| 41 | connecting plate |
| 42 | aperture |
| 43 | connecting member |
| 44 | accommodation |
| 45 | duct/guide |
| 46 | duct |
| 47 | duct |
| 48 | recess |
| 49 | step |
| 50 | recess |
| 100 | vacuum cleaner |
| 101 | suction tube |
| 102 | suction hose |
| 103 | floor nozzle |

The invention claimed is:

1. A vacuum cleaner assembly comprising: at least one suction device with at least one basic body configured hollow at least in sections; with at least one first end with at least one suction inlet, in particular for connection with at least one of a suction tube or a suction hose of a vacuum cleaner;

the basic body divides at a second end into at least two suction ducts which are tubular in shape, each suction duct having at least one suction intake; wherein a suction arm is associated with each of the two suction intakes; and wherein the suction arms are pivotable about an associated suction duct, wherein the suction arms are retained in an initial position by at least one biasing device, wherein the suction arms protrude laterally from the basic body to the left and right, wherein the suction arms are pivotable against a force of the at least one biasing device, from the initial position to one or more pivot positions, whereby a rotation of at least 90° both in a first, forward, direction and also in a second, rearward, direction relative to the initial position can be obtained, and whereby the suction arms automatically reset by means of the at least one biasing device when the force stops acting against the at least one biasing device.

2. The vacuum cleaner assembly according to claim 1, wherein each said suction arm is received on at least one suction duct.

3. The vacuum cleaner assembly according to claim 1, wherein at least one suction duct is a part of one of the suction arms.

4. The vacuum cleaner assembly according to claim 1, wherein one of the suction arms comprises at least one connecting device for accommodation on at least one suction duct, wherein the at least one connecting device includes one of at least one connecting with at least one pivoting sleeve rotatable thereto, and at least one connecting plate with at least one aperture and at least one connection member to pivotally take up one or more of the suction arms at the at least one aperture of the at least one connecting plate.

5. The vacuum cleaner assembly according to claim 4, wherein the at least one biasing device comprises one of a spring, a rubber element, a spring rod or another biasing member, and at least one covering device.

6. The vacuum cleaner assembly according to claim 1, wherein the at least one biasing device is received at the basic body and at least one of the suction arms.

7. The vacuum cleaner assembly according to claim 1, wherein at least one of the suction arms comprises at least one air baffle.

8. The vacuum cleaner assembly according to claim 1, wherein at least one of the suction arms and an air baffle together comprise at least one glide device.

9. The vacuum cleaner assembly according to claim 8, wherein the at least one suction arm and the air baffle comprise at least one air ducting in functional connection with at least one suction intake of the two suction intakes.

10. The vacuum cleaner assembly according to claim 1, wherein at least one of the suction arms is associated with at least one cover.

11. The vacuum cleaner assembly according to claim 1, wherein at least one of the suction arms comprises at least one brush device in particular with at least one brush.

12. The vacuum cleaner assembly according to claim 11, wherein the at least one brush device is at least partially disposed between an air baffle and a cover.

13. The vacuum cleaner assembly according to claim 11, wherein the at least one brush device is configured for one or more of at least partial retracting and extending.

14. The vacuum cleaner assembly according to claim 11, wherein one of the at least one brush device and a locking device comprises at least one selection device.

15. The vacuum cleaner assembly according to claim 14, wherein the at least one selection device comprises at least one actuating member.

16. The vacuum cleaner assembly according to claim 14, wherein the at least one selection device comprises at least one adjustment device.

17. The vacuum cleaner assembly according to claim 16, wherein the at least one adjustment device comprises at least one lever shaft.

18. The vacuum cleaner assembly according to claim 16, wherein the at least one adjustment device comprises at least one resetting device, in particular comprising at least one spring.

19. The vacuum cleaner assembly according to claim 14, wherein the at least one selection device comprises at least one shifting device.

20. The vacuum cleaner assembly according to claim 19, wherein the at least one shifting device is configured plate-shaped.

21. The vacuum cleaner assembly according to claim 20, wherein the at least one shifting device comprises at least one recess, by means of which the at least one shifting device is accommodated at an associated suction duct of the at least two suction ducts.

22. The vacuum cleaner assembly according to claim 19, wherein the at least one shifting device comprises at least one first fastening member, and wherein one of the at least one suction arm and at least one suction duct comprises at least one second fastening member which intersects with the at least one first fastening member of the at least one shifting device.

23. The vacuum cleaner assembly according to claim 1, wherein at least one locking device is provided for locking one or more of the suction arms.

24. The vacuum cleaner assembly according to claim 1, wherein at least one of the suction arms comprises at least one end support for an adjustment device.

25. The vacuum cleaner assembly according to claim 24, wherein at least one shifting device is in functional connection with one or more of the adjustment device and an actuating member.

26. The vacuum cleaner assembly according to claim 25, wherein at least one transmission member is disposed between the actuating member and the adjustment device.

27. The vacuum cleaner assembly according to claim 1, wherein at least one fastener is provided between an air baffle and a cover.

28. The vacuum cleaner assembly according to claim 27, wherein the at least one fastener is part of the air baffle, wherein the at least one fastener guides a brush device or guides a resetting device.

29. A vacuum cleaner with the vacuum cleaner assembly according to claim 1.

30. The vacuum cleaner assembly according to claim 1, wherein said suction arms are constructed and arranged to be free of contact with each other through said one or more pivot positions.

* * * * *